United States Patent [19]

Deppeler

[11] 3,942,538

[45] Mar. 9, 1976

[54] ELECTRICAL BACK-COMBING DEVICE

[76] Inventor: René Deppeler, 38, rue du Stank, 1200 Geneva, Switzerland

[22] Filed: Mar. 27, 1972

[21] Appl. No.: 238,105

[30] Foreign Application Priority Data

Mar. 29, 1971 Switzerland ..... 4578/71

[52] U.S. Cl. ..... 132/11 R

[51] Int. Cl.[2] ..... A45D 24/00

[58] Field of Search ..... 132/11 A, 11 R, 34 R, 9, 132/7, 139, 160, 142, 1; 128/52; 15/22, 22.3

[56] References Cited

UNITED STATES PATENTS

| | | | |
|---|---|---|---|
| 1,357,031 | 10/1920 | Daugherty | 132/11 A |
| 2,095,956 | 10/1937 | Bess | 128/52 |
| 3,386,453 | 6/1968 | Roberts et al. | 132/11 R |
| 3,421,522 | 1/1969 | Magguilli | 132/11 R |

*Primary Examiner*—G. E. McNeill

*Attorney, Agent, or Firm*—Raymond A. Robic; Arthur Schwartz

[57] ABSTRACT

An electrically driven back-combing device comprising a comb, a housing provided with an aperture at one extremity, and means for swinging the comb with respect to the housing. The swinging motion of the comb is produced by a cam disc, rotated by an electric motor, which imparts movement to a cam-following means. The cam-following means transmits its movement to a swinging lever on which is mounted the comb.

5 Claims, 3 Drawing Figures

ELECTRICAL BACK-COMBING DEVICE

The present invention relates to an electrically driven back-combing device fitted with a comb.

This instrument is designed to push the hair back towards the scalp by means of minimum number of short lengthwise strokes, in such a way that the hair remains in this position, thus forming a stable basis over which to draw a top layer of hair brushed into the desired style.

Several special combs are already in existence, the design of which is based on the particular form or arrangement of the teeth. Among others, certain existing combs have a row of coarse teeth combined with a row of finer teeth. It is however a tiring and time-consuming operation for a hairdresser to use such devices, as they necessitate a constant rotation in the hand during the back-combing.

In order to overcome these disadvantages, different combs have been developed in which every second tooth has been shortened. These combs present some advantages over the earlier models, but they are neither able to give a firm basis for the final hair styling nor do they permit a rapid back-combing.

Another comb has been developed in which there are several equidistant parallel rows of teeth, every third one of which is shorter than the others. This device presents a real technological advance in that it enables the elaboration of a perfectly stable base for subsequent hair styling, but its operation remains time consuming and tiring. Also, the fact that the back-combing is too exhausting to be carried out by certain people, represents a very great drawback for the hair-dresser.

There are also devices fitted with an electrically driven mechanism which imparts a rapid to- and fro movement to the comb. This mechanism consists of a rotating wheel on which is fixed an excentric pin, which in turn slides an elongated, narrow groove in the arm which supports the comb. The drawback to this device is that the comb powered by the above mentioned pin and groove system continues to vibrate even when the hair offers considerable resistance to its motion.

The strain thus applied to the mechanism, especially when the hair offers strong resistance, may cause a break down in the transmission. Consequently this back-combing appliance is also not completely satisfactory.

The following description concerns the present invention which presents none of the above-mentioned disadvantages.

This device is an improved electrically driven vibrating comb. The to- and fro movement is produced by an electrically powered cam disc rotating against a contact which transmits the motion to a swinging lever supporting the comb.

It is also an object of this invention to provide an improved back-combing device with a detachable comb which could be replaced by another comb selected by the hairdresser for a particular hairstyle.

A further intention is to enable a precise isolation of the sections of the hair to be backcombed.

Furthermore this invention is intended to allow for an improvement in the correct shaping of the hairstyle.

Yet another advantage is the improved drawing mechanism which is easily controlled without a switch.

The novel features that are considered characteristic of this invention are set forth with particularity in the appended claims. The invention itself, however, both as to its organization and its method of operation, together with additional objects and advantages thereof will best be understood from the following description of the preferred embodiment when read in connection with the accompanying drawings. The same numbers are used in all figures to denote any one part.

Figure 1:
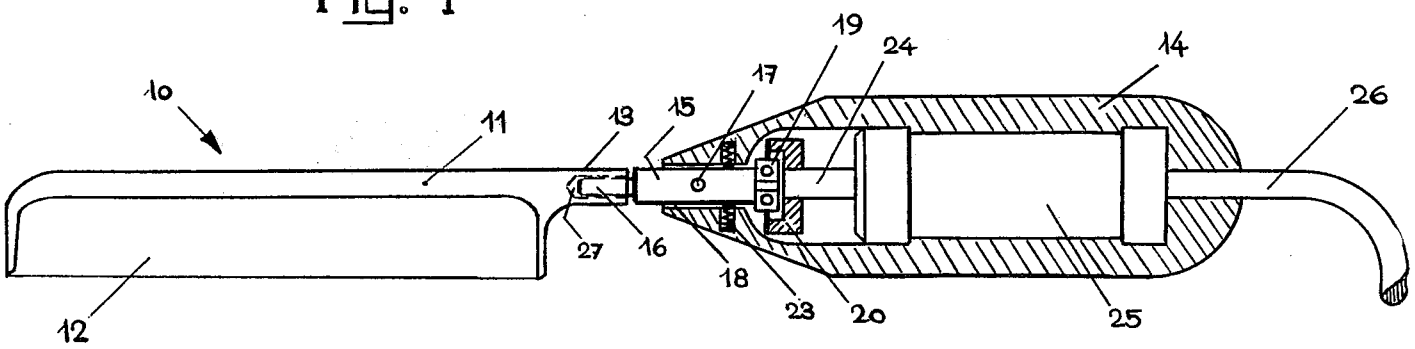
FIG. 1 is a longitudinal section of an electric back-combing device showing the features of this invention.
Figure 2:
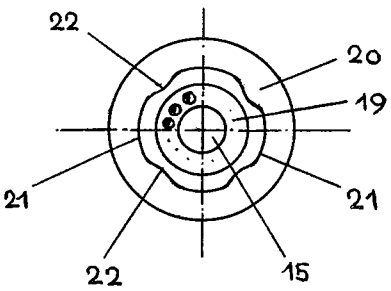
FIG. 2 is a transverse section showing the various parts of the mechanism which produces the vibration of the comb.

The illustrated preferred embodiment of this invention may best be understood by refering to FIG. 1 of the drawings. As may be seen therein a comb 10 is made up of a back element 11 and teeth 12. In a preferred embodiment every second tooth is shortened. A comb with two parallel rows of teeth could be substituted. Those skilled in the art are already familiar with the different forms and arrangements of the teeth in such combs, which will not therefore be described in this text. The back 11 of the comb 10 is extended to form a shaft 13 in which there is a socket 27. This socket 27 can be fitted over and removed from the pin 16 at one extremity of the swinging lever 15.

The swinging lever 15 can turn on a pivot 17 fitted in the housing 14. An aperture 18 in the housing 14 allows the passage of the said swinging lever. The dimensions of this aperture 18 are calculated to allow a free swinging movement of the lever 15. The other extremity of the swinging lever 15 is provided with a ballbearing 19 which can be set in motion by a cam disc 20, both being situated within the housing 14.

The comb 10 is easily detachable from the swinging lever 15 and can be replaced by another according to the hair style selected. It would have been possible to make the comb 10 and the lever 15 as a single element but this would have complicated or preventd the interchanging of the combs.

The afore-mentioned cam disc 20 is a disc provided with a central aperture formed by four recesses 21 symmetrically disposed around the axis of the disc 20, each recess having the same radius as the ball-bearing 19. The four said recesses 21 of the cam disc 20 are separated from each other by four cam projections 22 thus forming an undulated surface over which, the outside casing of the ball-bearing 19 runs whenever the equilibrium of the swinging lever 15 is disturbed.

The oscillations of the comb are stabilized by a spiral spring 23 which is mounted in a cavity at one extremity of the housing 14, acting on the swinging lever 15 between the pivot 17 and the ball-bearing thus allowing a normal to- and fro motion but preventing any uncontrolled increase in vibration.

The cam 20 is fitted on the free end of the driving shaft 24 of a well-known type of electric motor 25. In the preferred embodiment chosen for the illustration of this invention the motor is connected to the main electricity supply by means of a cable 26. The electric motor may also be supplied from a chargeable battery or an accumulator lodged inside the housing 14 as is often the case in electric toothbrushes for example. To utilize this electric back comb 10 in accordance with the present invention, a comb 10 appropriatd to the desired hair style must be selected and fitted to the swinging lever 15. The switch which sets in motion the electric motor 25, and consequently the cam 20, is not represented in the diagram. This switch is either incorporated in the housing 14, in the case of an accumulator supplied appliance, or mounted on the cable 26 in the case of an appliance connected to the main electricity supply.

As soon as the comb exerts pressure on the hair the swinging lever 15 pivots around the pivot 17 causing the ball-bearing 19 to come in contact with the cam 20 which immediately imparts a to-and-fro movement to the comb 10.

Figure 3:
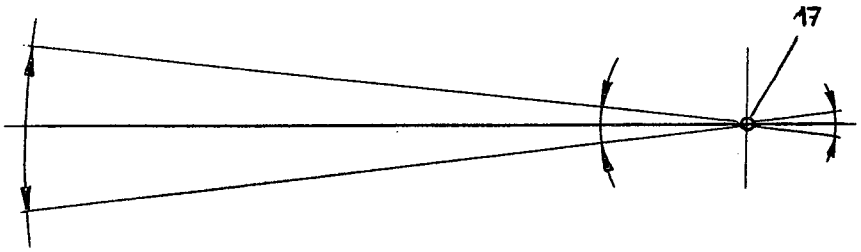
FIG. 3 is a graphic representation of the oscillating movement of the comb.

This movement is represented schematically in FIG. 3. The movement of the comb 10 is controlled by the spiral spring 23 which allows the normal swinging to-and-fro imparted by the ball-bearing 19 and the cam 20, but excludes any undesirable increase in vibration.

If the hair offers a resistance so great that there would be a risk of damaging the hairstyle, should the comb continue to oscillate, the ball-bearing 19 at the end, of the swinging lever 15 will automatically return to the central position where it does not come into contact with the recesses 21 and projections 22 on the inner surface of the cam 20.

The transmission will only be reconnected when the lever 15 is pivoted in the housing 14 as a result of a renewed contact with the hair to be back-combed.

Those familiar with the art will readily appreciate the novel and unique advantages of this invention. An efficient back-combing device is provided which facilitates the realization of better hairstyling because the sections of the hair to be back-combed can be isolated with precision.

As the swinging movements of the comb can be interrupted at will without the aid of a switch, this unique system is particularly well-adapted for back-combing.

No notable friction occurs between the cam 20 and the ball-bearing 19 because the said ball-bearing rolls on the surface of the said cam. In the preferred embodiment of this invention, the cam is made of a self-lubricating plastic material which renders regular lubrication superfluous.

The realization of this appliance may be carried out in other ways without departing from the spirit or essential character thereof. The preferred embodiment described herein is therefore to be considered illustrative and not restrictive, the scope of the invention being indicated by the appended claims and all variations which come within the meaning of the claims are intented to be embraced therein.

I claim:

1. An electrically driven back-combing device comprising a comb and means for swinging said comb with respect to a housing including a cam disc rotated by an electric motor located in said housing, a swinging lever pivotally mounted in said housing and projecting through the aperture in said housing for supporting said comb, and a cam following means adapted to engage said cam disc, wherein the cam disc is mounted on the driving shaft of the motor, said cam disc being provided with a central aperture including an interior surface having symetrically disposed recesses and projections adapted to contact said following means, and wherein the cam following means is a ball-bearing mounted on that extremity of the swinging lever which is situated inside the housing.

2. The back-combing device of claim 1, wherein the electric motor may be powered either by a main power supply or by an accumulator.

3. The back-combing device of claim 1, wherein the swinging lever pivots on a spindle fitted in the housing and supporting the comb on that extremity of the swinging lever which is situated outside the housing.

4. The back-combing device of claim 1, wherein the comb is detachable from the swinging lever in order to allow the interchanging of different-shaped combs.

5. The back-combing device of claim 1, wherein the movement of the swinging lever is controlled by a spiral spring which tends to restore the lever to a central position and consequently the comb, thus disengaging the said cam and the said cam following means.

* * * * *